APPARATUS FOR ADJUSTING THE THREAD FEED RATE OF A CIRCULAR KNITTING MACHINE

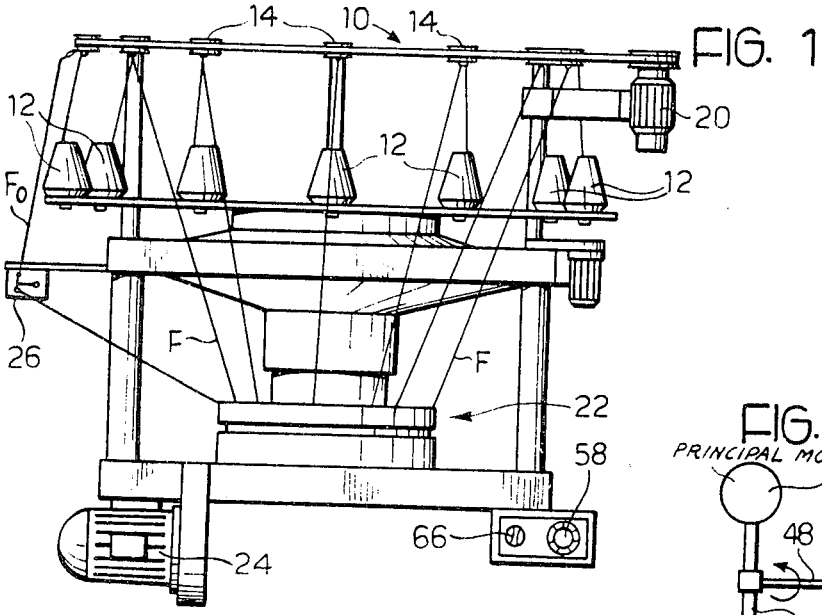
FIG. 1
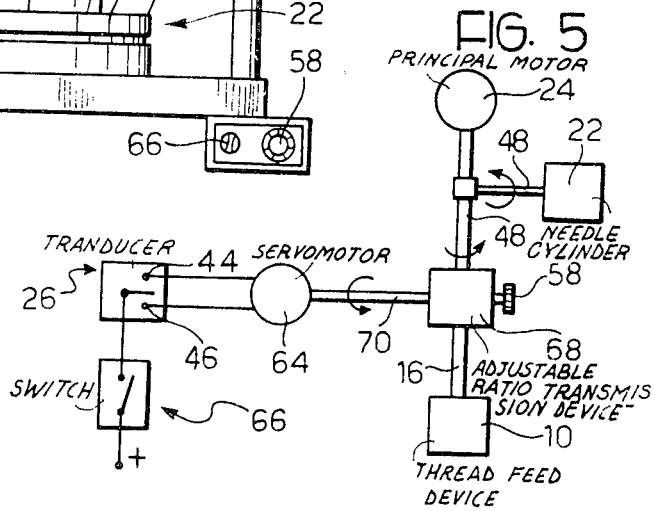
FIG. 5
FIG. 2
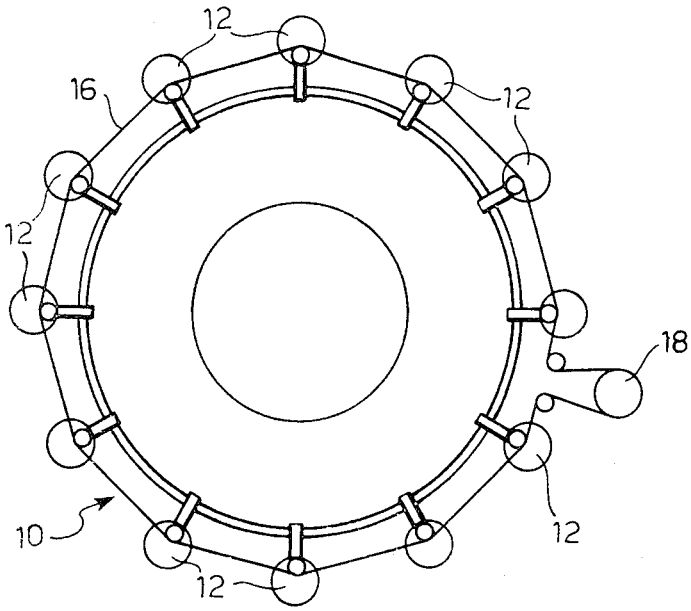

The present invention relates to apparatus for adjusting the thread feed rate of a multiple-feed circular knitting machine, of the type including a first rotary drive, which in known machines comprises the principal motor, for driving the needle actuating mechanism, normally a needle cylinder of the machine, at a predetermined speed, and a second common rotary drive for driving the thread feeds of the machine at a speed which is variable with respect to that of the first rotary drive.

In knitting machines of the aforesaid type, the take-up of threads by the needles varies considerably according to the type of fabric being produced such that it is necessary to adjust the ratio between the thread-feed rate and the working speed of the machine for each type of fabric. In a known machine of the aforesaid type this adjustment is carried out by means of a change-speed gear or adjustable ratio transmission device, forming part of the second rotary drive, which drives the drive pulley of a belt transmission which includes as many driven pulleys as there are thread feeds. In another very widely used machine, the drive pulley of the belt transmission is of variable diameter and constitutes the adjustable ratio transmission device.

These known solutions all have the disadvantage, however, of being considerably difficult to adjust since the adjustment relies on the judgment of the operator. Moreover, the adjustment can only be effected when the machine is stopped and, since adjustment is effected by trial and error, the machine must be restarted after each adjustment attempt in order to check whether the thread tension is correct. In view of the slight probability of producing the correct thread tension at the first adjustment attempt, it is almost inevitable that when the machine is started up thread breakages occur due to excess tension.

An object of the present invention is, therefore, to provide apparatus for adjusting the thread feed rate of a circular knitting machine of the above-mentioned type which can be used to adjust the thread feed rate, and consequently the thread tension, to the correct value, automatically at the start of working, without it being necessary to undertake adjustment by trial and error.

According to one aspect of the present invention there is provided apparatus for adjusting the thread feed rate of a multiple feed circular knitting machine of the type including a first rotary drive for driving the needle actuating mechanism of the machine at a predetermined speed and a second common rotary drive for driving each of the thread feeds of the machine at a speed which is variable with respect to that of the first rotary drive, characterised in that the apparatus includes a transducer mountable on the machine to be sensitive to the tension of one of the feed threads and responsive to variations therein to generate first or second electrical signals respectively whenever the tension of the thread is either greater than or less than a predetermined value;

control means connectable to the second rotary drive and to the transducer, and operable to increase or decrease the speed of the second rotary drive, and hence the thread feed rate, on receipt of a first or second signal respectively in order to bring the tension of the threads to the said predetermined value; and means for selectively enabling or disabling the said control means whereby to bring the apparatus into operation when required.

When in use in a multiple-feed circular knitting machine, the apparatus according to the invention allows the thread-feed rate to be adjusted automatically during operation of the machine to give a predetermined thread tension, the predetermined tension preferably being adjustable according to the type of knitting it is desired to carry out. Once a desired predetermined tension has been attained, knitting machines of the aforementioned type operate to maintain the tension and further adjustment is unnecessary and, in fact, undesirable as the apparatus according to the invention would correct for any slight variation in the tension in the thread being sensed, due, for example, to knots or lumps; this would give rise to a temporary variation in the feed rate of all the threads and the resulting knitted fabric would not have the desired evenness. The machine operator would therefore preferably operate the said means for disabling the control means once the machine is operating with the desired thread tension.

In a preferred embodiment of the invention the transducer comprises a rocker element, for example, a pivoted lever, which carries a thread deflector member engagable with the said one thread to deflect it from its normal feed path, biasing means which urge the rocker element, in use, in the direction of greater deflection of the said one thread and two electrical switches located one on each side of the rocker element so that one is operated when the rocker element is displaced by a predetermined amount to one side of an intermediate position which it occupies when the thread deflected by the deflector member has the predetermined tension, and the other is operated when the rocker element is displaced by a predetermined amount to the other side of this intermediate position.

According to a further aspect of the invention there is provided a multiple-feed circular knitting machine, characterised in that it includes apparatus for adjusting the thread feed rate as described above.

One embodiment of the invention will now be more particularly described, by way of example, with reference to the accompanying purely diagrammatic drawings, in which:

FIG. 1 is a side elevational view of a circular knitting machine provided with apparatus according to the invention for adjusting the thread feed-rate;

FIG. 2 is a diagrammatic plan view from above of the machine of FIG. 1;

FIG. 5 is a hybrid diagram of a second circular knitting machine provided with the apparatus according to the invention shown in FIGS. 1, 3 and 4.

Figure 3:
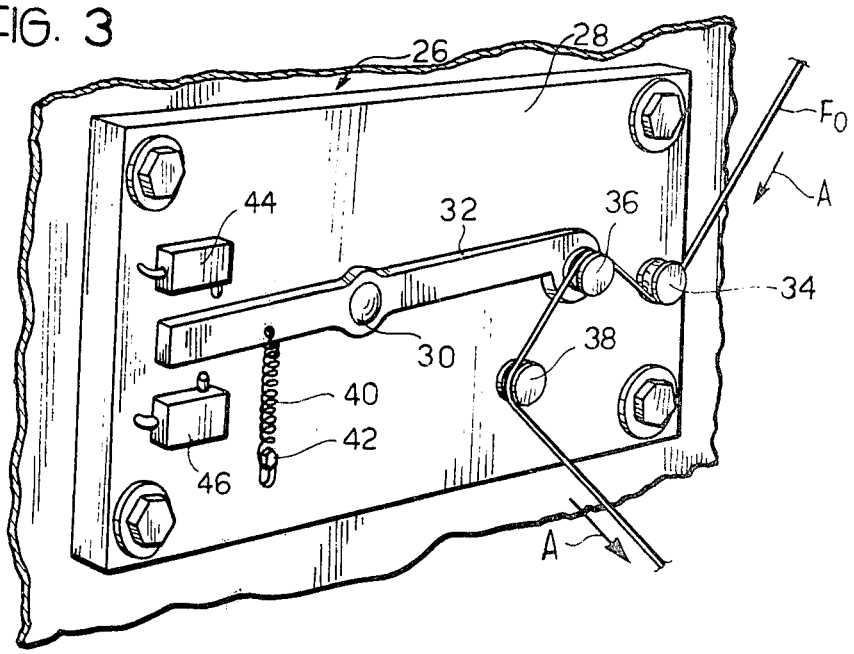
FIG. 3 is a diagrammatic perspective view, on a larger scale, of a transducer sensing forming part of the apparatus according to the invention shown in FIG. 1.

Referring to FIGS. 1 and 2 of the drawings, a multiple-feed circular knitting machine is shown, having a needle cylinder 22 and a thread feed device, generally indicated 10, including a plurality of spools 12 each of which forms part of an individual thread feed which also includes a pulley 14. All the pulleys 14 are engaged by a single drive belt 16 which, in use of the machine, is driven by means of a drive pulley 18, by a direct current electric motor 20, such that all the threads F are fed at switch 66 may be opened by means of the knob 66 shown in FIG. 1 to disable the servomotor.

If, for any reason it is necessary to correct the tension of the threads, that is their feed rate, during the operation of the machine, the operator can turn the knob 58 of the potentiometer 52 manually.

Referring to FIG. 5 of the drawings, a second multiple-feed circular knitting machine fitted with apparatus as described above is shown. In the machine of FIG. 5, the electronic speed control circuit of the above machine is replaced by a mechanical, hydraulic, or other adjustable ratio transmission device of any suitable type, indicated 68.

Figure 4:
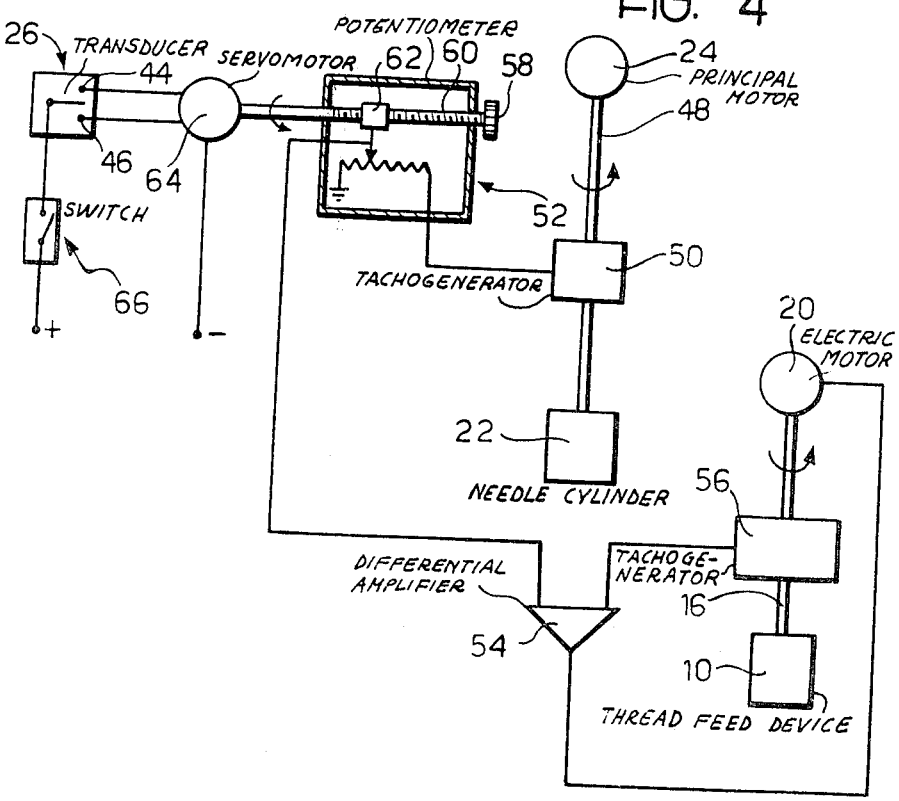
FIG. 4 is a hybrid diagram of the machine of FIG. 1.

In FIG. 5, the parts identical with those of FIG. 4 or having the same function, are indicated by the same reference numerals. Thus, the principal motor 24 is connected, by means of the drive 48, both to the needle cylinder 22 and to the input of the device 68, whilst the output of the latter is connected to the thread feed device 10 by the drive 16. The device 68 is furnished with a manual adjustment member 58 and with a shaft 70 connected to the servomotor 64 for varying the transmission ratio.

The operation of the apparatus according to the invention on the device 68 is as described with reference to FIGS. 1 to 4 and will not be described further.

What is claimed is:

1. Apparatus for adjusting the rate of feed, and hence the tension of the threads of a multiple-feed circular knitting machine of the type including:

a needle actuating mechanism, a first rotary drive for driving said needle actuating mechanism at a predetermined speed, a plurality of thread feeds, and a second common rotary drive for driving each of said thread feeds at a speed which is variable with respect to that of said first rotary drive, said apparatus including:

transducer means mountable on the machine to be sensitive to the tension of one of said feed threads and responsive to variations therein to generate first and second electrical signals respectively whenever the tension of said one feed thread is one of greater than and less than a predetermined value;

means controlling said second rotary drive;

means interconnecting in use said transducer means and said control means operating to feed said first and second signals to said control means;

means interconnecting in use said control means and said second rotary drive, whereby the speed of said second rotary drive is increased on receipt by said control means of said first electrical signal and decreased on receipt by said control means of said second electrical signal respectively in order to bring the tension of said threads to said predetermined value;

selective enabling means operable selectively to enable said control means whereby to bring the apparatus into operation when required; and said second rotary drive further comprising an electric motor having an electronic speed control circuit which receives an electrical input signal dependent on the speed of said first rotary drive, means incorporated in said electronic speed control circuit for adjusting the ratio between the speeds of said first and second rotary drives and means connecting said adjusting means to said control means.

2. The apparatus of claim 1, wherein said means for adjusting the speed ratio comprise a potentiometer having a wiper and means for effecting displacement of said wiper and wherein mechanical means connect said reversible servomotor to said displacement means.

3. The apparatus of claim 2, wherein said means for effecting displacement of said wiper of said potentiometer include an additional manual control member by means of which the speed of said second rotary drive can be adjusted when said control means are disabled.

* * * * *

United States Patent [19]

Valks et al.

[11] 4,194,376

[45] Mar. 25, 1980

[54] LEATHER PRESS

[75] Inventors: Robert K. Valks, Wetherby; Brian W. Botham, Bradford, both of England

[73] Assignee: USM Corporation, Farmington, Conn.

[21] Appl. No.: 895,740

[22] Filed: Apr. 13, 1978

[30] Foreign Application Priority Data

Apr. 16, 1977 [GB] United Kingdom ..... 15875/77

[51] Int. Cl.[2] ..... C14B 1/30

[52] U.S. Cl. ..... 69/48

[58] Field of Search ..... 69/8, 48; 12/33, 36, 12/36.5, 36.8, 37, 38, 16.1, 16.4; 38/25, 71, 72; 68/241, 242

[56] References Cited

U.S. PATENT DOCUMENTS

| | | | |
|---|---|---|---|
| 1,332,963 | 3/1920 | Tucker et al. | 69/48 |
| 1,375,469 | 4/1921 | Richard | 69/48 |
| 1,533,115 | 4/1925 | Hulbert | 69/48 |

*Primary Examiner*—Patrick D. Lawson

*Attorney, Agent, or Firm*—Donald N. Halgren; Richard B. Megley; Vincent A. White

[57] ABSTRACT

A leather press in which two wedges are synchronously driven to raise a lower platen in the press from an open condition to a position adjacent an upper platen of the press. The lower platen is movably mounted on a support. The support and the wedges are in slidable engagement with one another to effect a preliminary closing of the press. A pressurizable expandable member such as a flexible diaphragm may be mounted between the movable platen and the support so that the platens are secondarily urged together by the application of hydraulic pressure, to apply the required working pressure, to a leather workpiece disposed between the platens. The diaphragm is preferably provided by a wall portion of an inflatable sac.

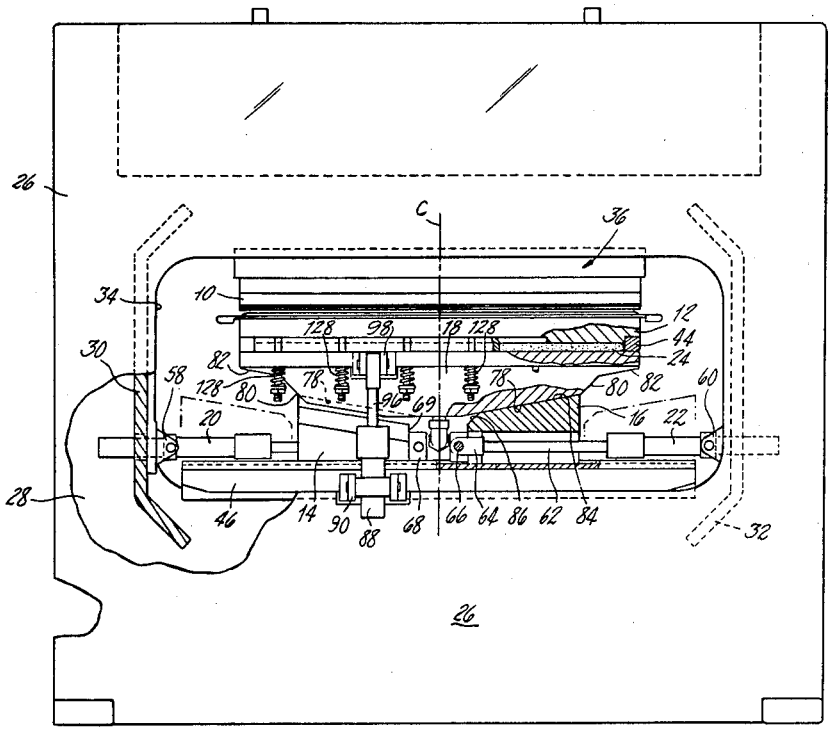

12 Claims, 5 Drawing Figures